US011779110B2

(12) United States Patent
Lattimore

(10) Patent No.: US 11,779,110 B2
(45) Date of Patent: Oct. 10, 2023

(54) ACCESSORY ORGANIZER DEVICE

(71) Applicant: Denine Lattimore, New York, NY (US)

(72) Inventor: Denine Lattimore, New York, NY (US)

( * ) Notice: Subject to any disclaimer, the term of this patent is extended or adjusted under 35 U.S.C. 154(b) by 0 days.

(21) Appl. No.: 17/901,002

(22) Filed: Sep. 1, 2022

(65) Prior Publication Data

US 2023/0062557 A1 Mar. 2, 2023

Related U.S. Application Data

(60) Provisional application No. 63/240,057, filed on Sep. 2, 2021.

(51) Int. Cl.

| | |
|---|---|
| ***A47B 61/04*** | (2006.01) |
| ***A47B 61/00*** | (2006.01) |
| *A47F 5/02* | (2006.01) |
| *A47F 5/08* | (2006.01) |
| *A47G 25/06* | (2006.01) |

(52) U.S. Cl.

CPC ..... *A47B 61/04* (2013.01); *A47B 61/003* (2013.01); *A47F 5/02* (2013.01); *A47F 5/0876* (2013.01); *A47G 25/0614* (2013.01)

(58) Field of Classification Search

CPC ..... A47B 61/003; A47B 61/04; A47F 5/08; A47F 5/0807; A47F 5/0876; A47F 5/0815; A47F 5/02; A47F 7/0028; A47G 25/746; A47G 25/0607; A47G 25/0614

See application file for complete search history.

(56) References Cited

U.S. PATENT DOCUMENTS

| | | | | | |
|---|---|---|---|---|---|
| 1,447,636 | A * | 3/1923 | White | A47G 25/08 | 211/35 |
| 2,532,517 | A * | 12/1950 | Schwartzman | A47G 25/005 | 383/39 |
| 3,967,666 | A * | 7/1976 | Farrar | A61G 7/0503 | 383/7 |
| 4,296,876 | A * | 10/1981 | Lefebvre | A47G 25/54 | 223/91 |
| 4,401,219 | A * | 8/1983 | Mink | A45C 11/16 | 206/466 |
| 4,585,127 | A * | 4/1986 | Benedict | A47B 61/02 | 211/94.01 |
| D291,754 | S * | 9/1987 | Griswold | D6/573 | |
| 4,771,899 | A * | 9/1988 | Benedict | A47B 61/02 | 211/94.01 |

(Continued)

*Primary Examiner* — Devin K Barnett

(74) *Attorney, Agent, or Firm* — Brennan, Manna & Diamond, LLC

(57) ABSTRACT

The present invention relates to a hanging accessory coordinator or organizer including a plurality of pockets with dividers for storing accessories and clothing items in an organized manner. The coordinator or organizer has an adjustable hook for hanging a planar surface of the tool, the hook has a telescoping sliding member to adjust distance of the planar surface from a wall upon which the hook is mounted and has a swivel mechanism to turn the planar surface relative to the hook. The planar surface has a plurality of elastic or fiber pockets with or without dividers for storing accessories. The tool has other storage spaces with fasteners for storing items that are easy to retrieve. The tool can be hung inside a closet or on a door of a closet.

12 Claims, 5 Drawing Sheets

(56) References Cited

U.S. PATENT DOCUMENTS

D300,399 S * 3/1989 Krugman ..... D6/514
4,811,852 A * 3/1989 Kelly ..... A47G 25/743 211/89.01
5,025,918 A * 6/1991 Bergeron ..... A45C 9/00 206/495
5,125,519 A * 6/1992 Cambria ..... A45C 3/02 211/113
5,209,344 A * 5/1993 Smith ..... A45C 11/16 206/466
D337,467 S * 7/1993 Schmidt ..... D6/570
5,295,587 A * 3/1994 Downes ..... A47G 25/14 211/85.2
5,421,465 A * 6/1995 Dunner, Jr. ..... A47G 25/743 211/115
5,533,534 A * 7/1996 Cariello ..... A47K 3/281 211/38
D392,806 S * 3/1998 Lee ..... D6/320
6,220,436 B1 * 4/2001 Chung ..... A45C 7/0095 206/424
D456,517 S * 4/2002 Kraska ..... D24/189
D547,989 S * 8/2007 Nelson ..... D6/553
D595,918 S * 7/2009 Walter ..... D34/27
7,748,584 B2 * 7/2010 Easom ..... B25H 3/00 224/563
D666,440 S * 9/2012 Kinskey ..... D6/514
9,287,107 B2 * 3/2016 Powell ..... H01K 3/305
9,675,149 B1 * 6/2017 Saffold ..... A45C 11/04
D805,800 S * 12/2017 Manzione ..... D6/514
10,568,421 B2 * 2/2020 Felsenthal ..... A47G 29/087
10,856,657 B2 * 12/2020 Felsenthal ..... A47B 61/04
2003/0164345 A1 * 9/2003 Jones ..... A47J 47/16 211/118
2003/0221978 A1 * 12/2003 Redzisz ..... A45C 13/04 206/278
2004/0140282 A1 * 7/2004 Wang ..... A47F 7/146 211/113
2005/0230336 A1 * 10/2005 Mundy ..... A47G 29/08 211/113
2009/0057247 A1 * 3/2009 Kraft ..... A47J 45/02 211/41.11
2015/0137672 A1 * 5/2015 Caskenette ..... A47F 7/146 312/188

* cited by examiner

ACCESSORY ORGANIZER DEVICE

CROSS-REFERENCE TO RELATED APPLICATION

The present application claims priority to, and the benefit of, U.S. Provisional Application No. 63/240,057, which was filed on Sep. 2, 2021 and is incorporated herein by reference in its entirety.

FIELD OF THE INVENTION

The present invention relates generally to the field of clothing and accessory organizers. More specifically, the present invention relates to a unique clothing accessory coordinator or organizer device that can be hung inside a closet or on a door for storing clothing and accessories in plain view. The device features a plurality of fabric or elastic pockets with dividers to easily store and organize shoes, pocketbooks, scarves, hats, gloves, belts, and much more. The device has an adjustable hook system and a swivel mechanism that allows adjustment and pivot of the device as per size and design of the closet while maintaining plain view of stored items. Accordingly, the present disclosure makes specific reference thereto. Nonetheless, it is to be appreciated that aspects of the present invention are also equally applicable to other like applications, devices, and methods of manufacture.

BACKGROUND

By way of background, individuals may store coats, shirts, pants, shoes, and numerous other clothing items and accessories in a closet. Standard closets have multiple partitions for keeping different kinds of items such as shirts, pants, shoes, coats, etc., however, due to limited number of partitions and size limitations of closets, individuals may end up keeping different kinds of items in a single portion of the closet. Individuals may find it too difficult to keep the closet well organized. Due to lack of space in closets, the closets are usually unorganized. While searching for a particular item, individuals have to sift through all items in the closet to locate a specific garment or accessory, which can be frustrating for the individuals.

Further, individuals may forget certain items in the back of their closet that may perfectly accentuate a specific outfit or style. Due to unorganized closet, individuals may be unable to get desired matching accessories for their outfits and may lose the opportunity to get the perfect look for any event/occasion. Also, in situations where individuals do not find a particular accessory, shoes, or the like in their closet that matches to their outfit, some individuals may end up buying new accessories, shoes, and more, to coordinate with their outfits, thereby adding onto the existing items in the closet. This eventually leads to having more items in the closet, which makes it more unorganized. Currently, individuals waste a lot of time in looking for the desired item in the closet and sometimes even fail to find the desired item when it is required. Some individuals may keep multiple closets to organize their items properly, however, this occupies more square footage within a home and makes the living space cramped. Individuals desire a solution for organizing their closets in a convenient manner.

Therefore, there exists a long felt need in the art for a device that enables the individuals to organize different kinds of items such as shoes, shirts, pants, coats, belts, accessories, and more in different partitions. There is also a long felt need in the art for a device that ensures the closet remains well organized. Additionally, there is a long felt need in the art for a device that ensures individuals have enough space to organize all their items and are able to locate the desired item readily. Moreover, there is a long felt need in the art for a device that eliminates the need to buy or construct multiple closets to organize all their items properly. Further, there is a long felt need in the art for a device that ensures the room and/or closet looks spacious and appealing to the users. Furthermore, there is a long felt need in the art for a device that allows the users to quickly find the required items to coordinate with their outfits. Finally, there is a long felt need in the art for a device that organizes all the items such that individuals do not have to sift through all the items to locate a particular item, and therefore saves the time and effort of the users.

The subject matter disclosed and claimed herein, in one embodiment thereof, comprises an accessory coordinator or organizer system. The system is designed as an organizational tool for clothing accessories capable of being hung inside a closet or on the door and enables users to locate and mix and match the accessories easily. The system further comprising a planar surface made of fabric, the planar surface is generally rectangular or square and extends between two longitudinal edges and a top lateral edge and a bottom lateral edge; an adjustable and removable hook system configured to mount to a wall for hanging said planar surface; the hook system having a swivel mechanism for turning or pivoting said planar surface relative to the hook system; and a plurality of pockets disposed on the planar surface for storing clothing accessories, at least some of the pockets have a divider slot therein for receiving a divider to divide the pocket into two portions.

In this manner, the accessory coordinator or organizer system of the present invention accomplishes all of the forgoing objectives and provides users with an organizational tool for clothing accessories capable of being hung inside a closet or on its door. The system features an adjustable and removable hook mechanism to hang the system in or on the closet to keep all stored items in plain view of easy accessibility. The system enables users to mix and match accessories from an easily accessible location and improves organization in a home while offering a way for individuals to readily obtain a desired outfit and style.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an accessory coordinator or organizer system. The system further comprising a planar surface, said planar surface made of fabric, is generally rectangular or square and extending between two longitudinal edges and a top lateral edge and a bottom lateral edge; a hook system coupled to the planar surface at the top lateral edge; the hook system is configured to mount to a wall for hanging said planar surface; the hook system having a swivel mechanism for turning or pivoting said planar surface relative to the hook system; and a plurality of pockets disposed on the planar surface for storing clothing accessories, at least some of the pockets have a divider slot therein for receiving a divider to divide the pocket into two portions. The hook system has a telescoping sliding arm to selectively increase or decrease the distance of the hanging planar surface from the wall to which the hook is mounted.

In yet another embodiment, the accessory coordinator or organizer device includes a hanger attachment along the longitudinal edges wherein the hanger attachment has a plurality of hanger protrusions for hanging clothing accessories.

In yet another embodiment, a clothing accessory organization tool is disclosed. The organization tool includes a planar wall having a plurality of pockets disposed thereon for storing clothing accessories, the planar wall is configured to hang from a hook system, the hook system is mounted to a wall and has a swivel mechanism having a fixed member attached to the hook and a turning member attached to top edge of the planar wall, wherein the turning member and the fixed member are coupled using a rotating lever, the turning member is configured to turn or pivot relative to the fixed member to turn the planar wall, the hook system has a telescoping sliding arm to adjust the distance of the hanging planar wall from the closet wall to which the hook is fastened.

In yet another embodiment, the organization tool has zipped storage space for storing shoes, belts, and other clothing accessories.

In yet another embodiment, the organization tool has a plurality of elastic pockets with removably inserted dividers.

In yet another embodiment, the planar wall is made from a single piece of fabric and has a stiffener along the edge for increasing rigidity and increasing load carrying capacity of the organization tool.

In yet another embodiment, the organization tool is installed inside a closet or on a closet door.

In yet another embodiment, the hook has three telescoping holes in which a locking pin of the sliding arm can be locked.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
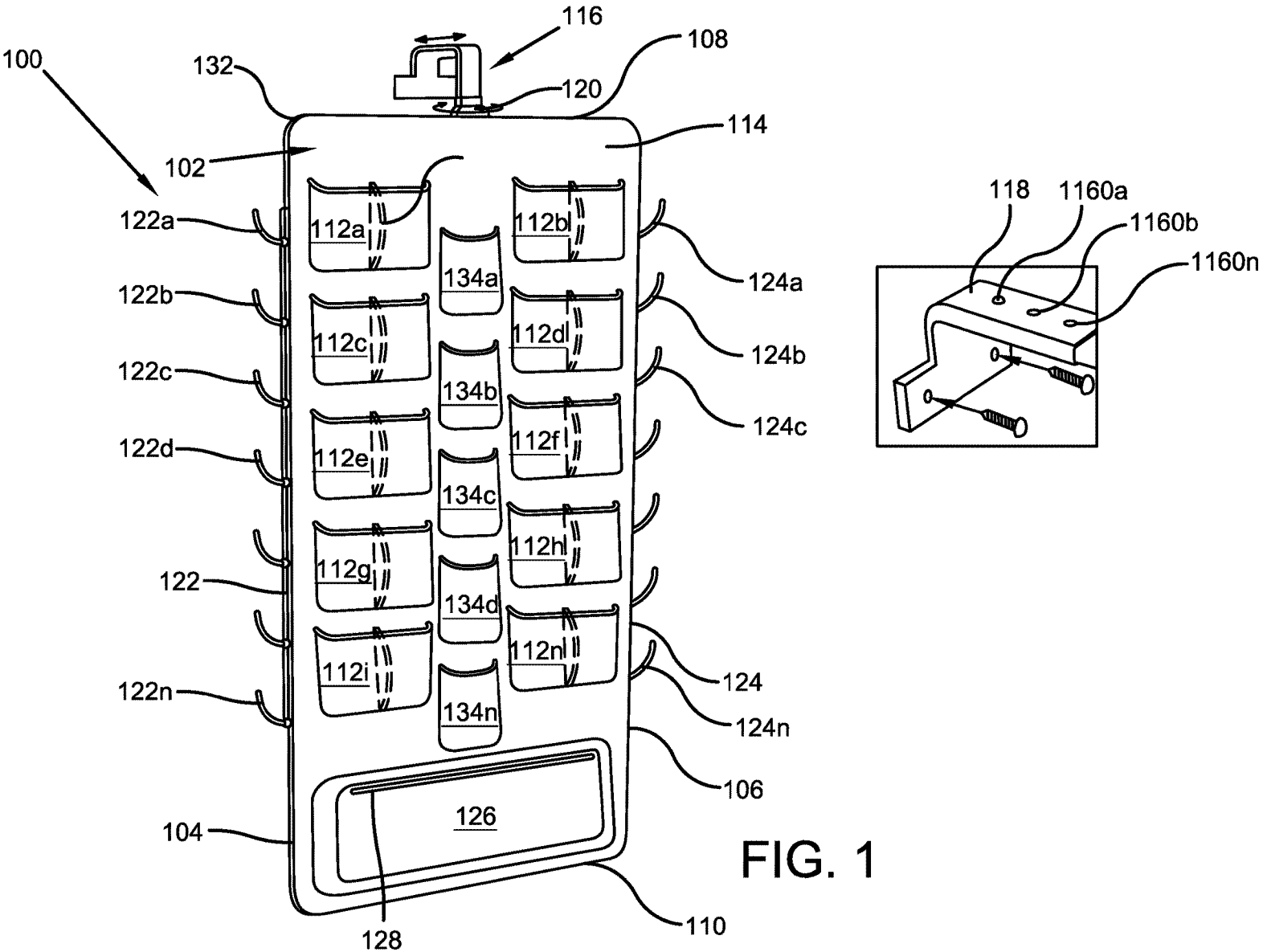
FIG. 1 illustrates a perspective view of a hanging accessory coordinator or organizer of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a device that enables the individuals to organize different kinds of items such as shoes, shirts, pants, coats, belts, accessories, and more in different partitions. There is also a long felt need in the art for a device that ensures the closet remains well organized. Additionally, there is a long felt need in the art for a device that ensures individuals have enough space to organize all their items and are able to locate the desired item readily. Moreover, there is a long felt need in the art for a device that eliminates the need to buy or construct multiple closets to organize all their items properly. Further, there is a long felt need in the art for a device that ensures the room and/or closet looks spacious and appealing to the users. Furthermore, there is a long felt need in the art for a device that allows the users to quickly find the required items to coordinate with their outfits. Finally, there is a long felt need in the art for a device that organizes all the items such that individuals do not have to sift through all the items to locate a particular item, and therefore saves the time and effort of the users.

The present invention, in one exemplary embodiment, is a novel organizational tool for clothing accessories. The organizational tool is capable of being hung inside a closet or on a door. The tool features an adjustable and removable hook mechanism to hang the tool in or on the closet (i.e. closet wall) to keep all stored items in plain view and includes multiple fabric or elastic pockets with dividers to easily store and organize items. The tool has additional storage space at the bottom and hanger attachments for hanging items. All items and accessories are kept in plain view and remain easily accessible, allowing users to mix and match their items to match an outfit or specific style.

Referring initially to the drawings, FIG. 1 illustrates a perspective view of a hanging accessory coordinator or organizer of the present invention in accordance with the disclosed architecture. The hanging accessory coordinator or organizer 100 of the present invention is designed as an organizational tool capable of being hung inside a closet or on its door for organizing clothing accessories. The accessory coordinator or organizer 100 includes removable side hooks that can be used for holding pocketbooks, scarves, gloves, hats, belts, ties and numerous other clothing accessories. More specifically, the accessory coordinator or organizer 100 includes a planar wall (surface) 102 that has two opposing longitudinal edges 104, 106 and two opposing lateral edges 108, 110. A plurality of pockets 112*a-n* are positioned on the top or front surface 114 of the wall 102 for holding clothing accessories. The pockets 112*a-n* are elastic and may be made from transparent, translucent, or opaque fabric or plastic although various other materials may be used.

The hanging accessory coordinator or organizer 100 is configured to be mounted to a surface using the swivel hook mount 116. The hook mount 116 is configured to be mounted to a wall of the closet using mechanical fasteners as shown in FIG. 3. The hook system 116 is adjustable, removable and telescoping in structure. A plurality of telescoping holes 1160*a-n* are disposed in the horizontal arm 118 of the hook system 116 as described in FIG. 3. The swivel end 120 of the hook system 116 allows the direction of the planar wall 102 to adjust to conform to the shape and configuration of a closet in which the accessory coordinator or organizer is installed. Details of the swivel end 120 are described in detail in FIG. 2.

Each of the longitudinal edges 104, 106 has outwardly extending supporting hanger attachment for hanging belts, bands, or any additional items. The hanger attachment 122 is integrated or removably attached to the longitudinal edge 104 and has a plurality of arcuate protrusions 122*a-n* used for hanging clothing accessories. Similarly, the hanger attachment 124 is integrated or removably attached to the longitudinal edge 106 and has a plurality of arcuate protrusions 124*a-n* used for hanging clothing accessories. The length and number of protrusions of both the hanger attachments 122, 124 can be the same and further, the hanger attachments 122, 124 can be made from plastic or light metal that provides stability to the accessory coordinator or organizer 100. The hanger attachments also prevent the coordinator or organizer device 100 from swaying sideways when the door of closet is opened, for example.

A large storage space 126 secured by a fastener 128 such as a zipper, hook and loop fastener, snaps, or more, are disposed near the bottom edge 110 of the accessory coordinator or organizer 100 and can be used for shoes, belts, and more. The pockets 112*a-n* are distributed along the top or front surface 114 of the wall 102 for evenly distributing weight of accessories stored in the pockets 112*a-n*. Each pocket has a divider slot 130 in which a divider can be removably slotted in order to modify the pocket space for organizing multiple items in the pocket. The coordinator or organizer 100 may have a plurality of small pockets 134*a-n* without a divider for storing small accessories.

The planar wall 102 may be comprised of a single contiguous or uninterrupted piece of fabric material and the wall extends between the longitudinal edges 104, 106 and two opposing lateral edges 108, 110. The material of the wall 102 is generally held taut when accessories are stored in the pockets 112*a-n*, hanger attachments, and in the big storage space 126 and therefore, increases the load carrying capacity of the accessory coordinator or organizer 100.

In the preferred embodiment, a stiffener panel 132 may be attached to the seam of edges of the planar wall 102. The stiffener panel 132 can be configured to provide a greater degree of rigidity or stiffness to the planar wall 102 and may be fabricated from plastic, fiberboard, or more. The rigidity helps in increasing the load carrying capacity of the accessory coordinator or organizer 100. The stiffener panel 132 can be sewn to the seam of the edges or can be sandwiched in the fabric of the planar wall 102.

Figure 2:
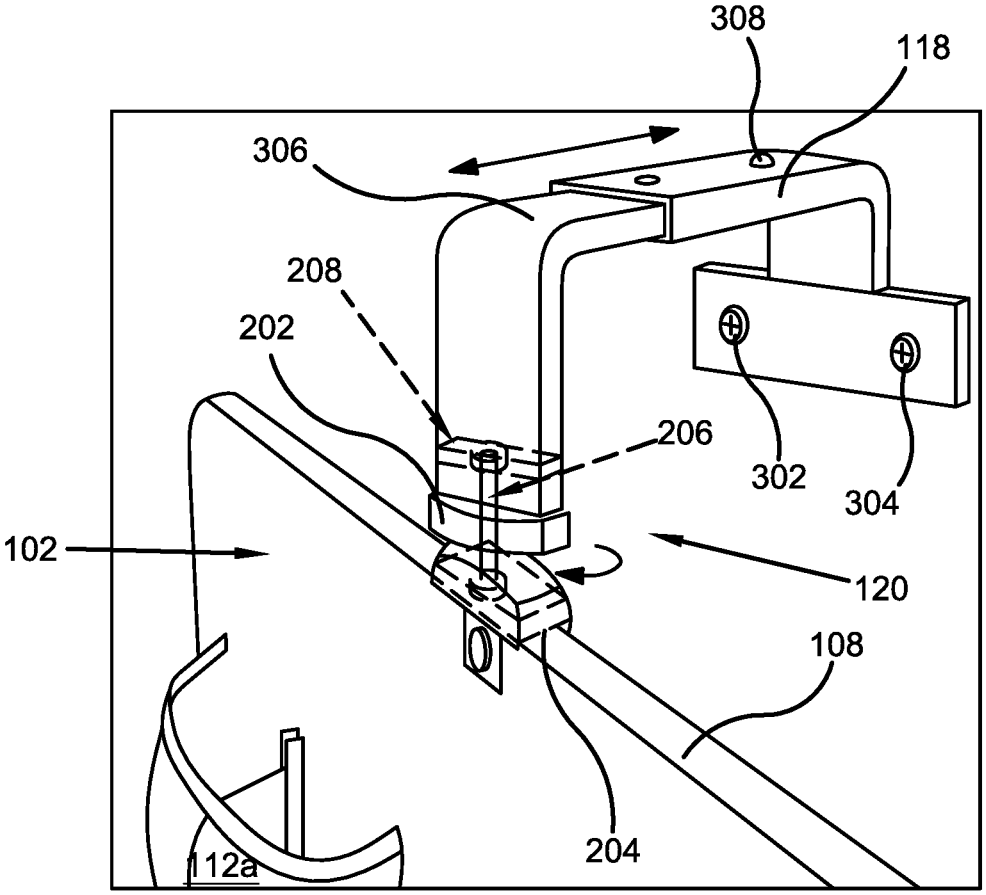
FIG. 2 illustrates a detailed view of a swivel mechanism used for turning the planar wall for easily accessing and consistently placing the accessories in a planar manner in accordance with the disclosed architecture.
Figure 3:
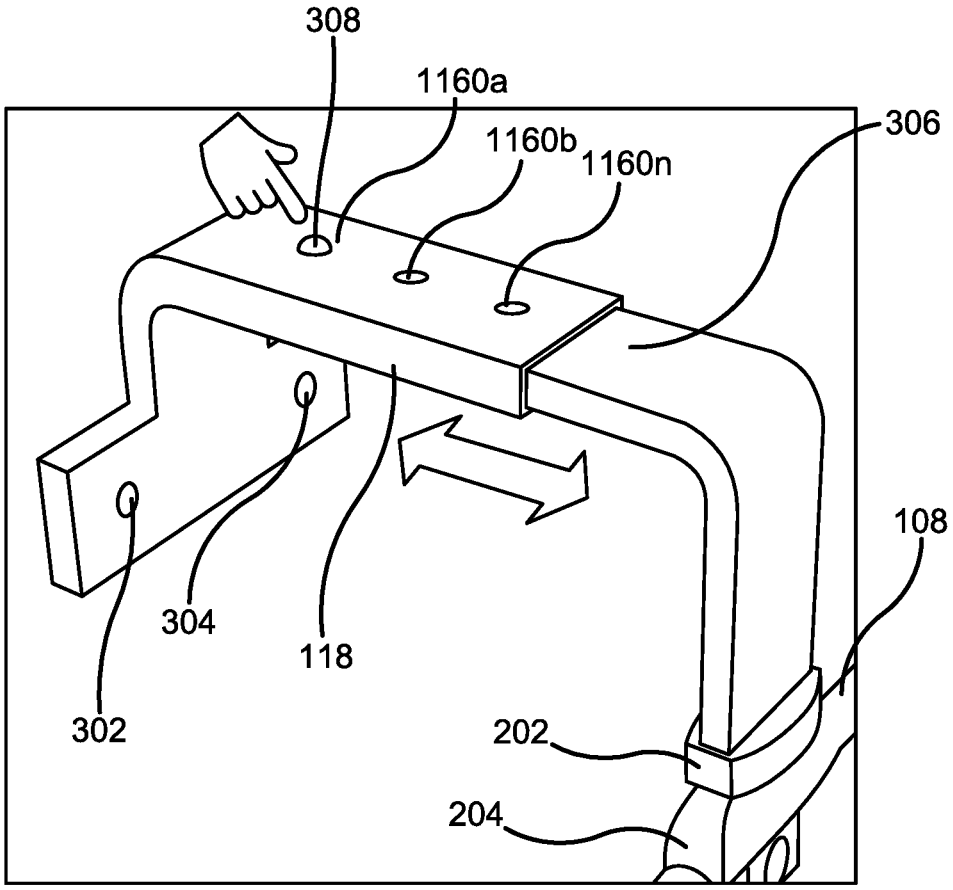
FIG. 3 illustrates an enlarged view of the mount hook system used for mounting the accessory coordinator or organizer to a wall for handling in accordance with the disclosed architecture.

FIG. 2 illustrates a detailed view of the swivel mechanism used for turning or pivoting the planar wall 102 for easily accessing and always placing the accessories in a planar manner in accordance with the disclosed architecture. The swivel end 120 of the accessory coordinator or organizer 100 is used for turning or pivoting the planar wall 102 in a desired direction for easy access of the stored accessories. The swivel end 120 has a first (fixed) member 202 rotatably coupled to a rotating (turning) member 204 using a rotating lever 206. The rotating level 206 has bearings 208 allowing turning or pivoting of the turning member 204 relative to the fixed member 202. The rotating member 204 is fastened to the top lateral edge 108 of the planar wall 102 using a fastener.

The rotating lever 206 allows the rotating member 204 to rotate or pivot relative to the first member 202 such that planar wall 102 is rotated in a desired direction. Specifically, a user holds the rotating member 204 and turns either clockwise or counterclockwise for turning the rotating member 204 relative to the first member 202 using the rotating lever 206. The rotating lever 206 is not visibly exposed from outside and performs the turning functionality internally between the members 202, 204.

FIG. 3 illustrates an enlarged view of the mount hook system 116 used for mounting the accessory coordinator or organizer 100 to a wall for handling in accordance with the disclosed architecture. The wall mounted hook 116 has a pair of holes 302, 304 configured to receive fasteners for screwing the hook system 116 to mount to a wall such as of a closet or to a door. For maintaining a desired distance from the wall while hanging the coordinator or organizer 100, a telescoping adjustable system is provided in the hook 116.

A plurality of telescoping holes 1160*a-n* are provided on the horizontal arm 118 of the hook 116 such that a sliding arm 306 having a locking pin 308 slides out or in to extend the length of the hook and adjust distance of the hanging planar wall 102 from the wall/surface to which the hook 116 is mounted. The locking pin 308 is configured to engage with one of the holes 1160*a-n* for locking the sliding arm 306 at a desired position. For sliding in or out, the locking pin 308 is depressed by a user and then the sliding arm 306 is slid in or out as per desired preferences of a user to engage the pin 308 with another telescoping hole. The sliding arm 306 forms a part of the hook system 116 and is substantially L-shaped. Using the telescoping mechanism, the distance of the planar wall hanging at the swivel end can be adjusted by users. It should be noted that although only three holes are shown in the exemplary hook system, any number of holes with any length of the sliding arm 306 can be designed to achieve the outcome of the present invention.

Figure 4:
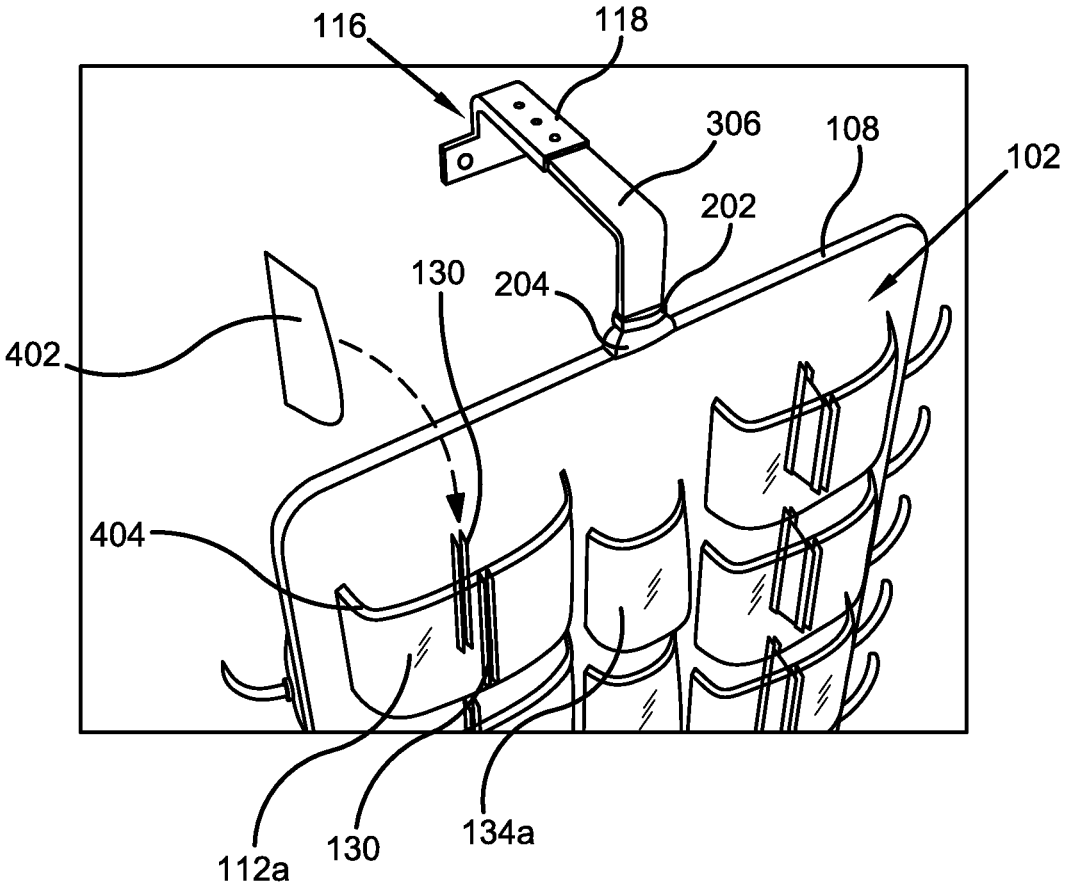
FIG. 4 illustrates an enlarged view showing the divider slots positioned in the pockets and how a divider is placed in a pocket to organize accessories in accordance with the disclosed architecture.

FIG. 4 illustrates an enlarged view showing the divider slots positioned in the pockets and how a divider is placed in a pocket to organize accessory in accordance with the disclosed architecture. The big pockets 112*a-n* have a divider slot 130 each for receiving and accommodating a divider 402 therethrough that helps in organizing accessories in the accessory coordinator or organizer 100. As illustrated, the divider slots 130 are positioned in each individual big pocket and removably accommodates the divider 402. Each big pocket has a top opening for storing and retrieving clothing accessories.

Each pocket (including big pocket 112*a-n* and small pocket 134*a-n*) can have an elastic or a hook and loop fastener along the top edge 404 for securing items stored in the pockets. It should be noted that pockets can be of any suitable size as per requirements of users and can be distributed in any configuration on the planar wall. Although in the various embodiments of the present invention, the pockets are disposed only on the top or front surface of the planar wall 102, but the pockets can be disposed on a rear surface of the planar wall 102 to increase the storage capacity of the hanging organizational tool 100 of the present invention.

Figure 5:
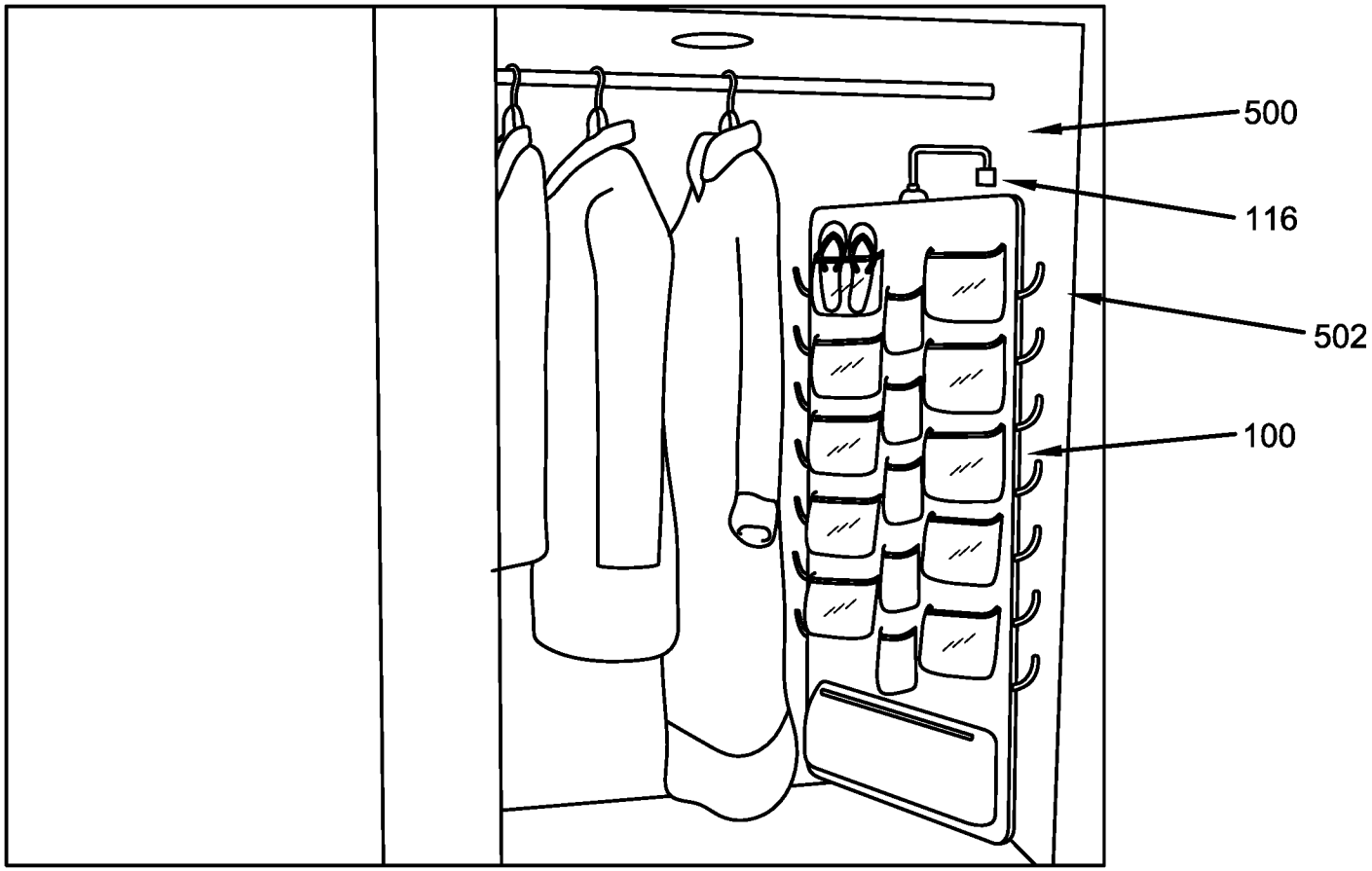
FIG. 5 illustrates the accessory organization tool of the present invention used in a closet for organizing accessories in accordance with the disclosed architecture.

FIG. 5 illustrates the accessory organization tool of the present invention used in a closet for organizing accessories in accordance with the disclosed architecture. The organization tool 100 can be installed in a closet 500 using the wall mounted hook 116. As per the design and configuration of the closet 500, the swivel mechanism can be used to turn, swivel, or pivot the planar wall as described in FIG. 2. The tool 100 is mounted to a surface 502 of the closet 500 using the hook 116 for installation of the tool 100.

The tool 100 can be used to easily store and organize shoes, pocketbooks, scarves, hats, belts, gloves, and much more, with easily accessible pockets. Further, the tool 100 enables users to mix and match accessories from an easily accessible location in the closet, obviating from having to constantly sift through clothing to find a specific item. All the items are kept in plain view and remain easily accessible.

Using the hook system 116, the tool 100 can be mounted to any vertical surface such as a door, wall, cabinet, and more. The tool 100 occupies less space and provides more storage space for clothing accessories.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "accessory organization tool", "accessory coordinator or organizer", "hanging accessory coordinator or organizer", "tool", and "coordinator or organizer" are interchangeable and refer to the accessory coordinator or organizer device 100 of the present invention.

Notwithstanding the forgoing, the accessory coordinator or organizer device 100 of the present invention can be of any suitable size and configuration as is known in the art without affecting the overall concept of the invention, provided that it accomplishes the above stated objectives. One of ordinary skill in the art will appreciate that the accessory coordinator or organizer device 100 as shown in the FIGS. are for illustrative purposes only, and that many other sizes and shapes of the accessory coordinator or organizer device 100 are well within the scope of the present disclosure. Although the dimensions of the accessory coordinator or organizer device 100 important design parameters for user convenience, the accessory coordinator or organizer device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A hanging accessory organizer comprising:

a planar wall having a front surface;

a pair of opposing longitudinal edges;

a pair of opposing lateral edges;

a plurality of pockets positioned on the front surface of said planar wall for retaining a plurality of clothing accessories, wherein said plurality of pockets are elastic;

a telescoping mounting hook for mounting said hanging accessory organizer a selective distance from a mounting wall; and a swivel mount for turning said hanging accessory organizer, wherein said swivel mount comprises a fixed member, a turning member, a rotating lever, and at least one bearing for turning said planar wall in a desired direction for easy access of the plurality of clothing accessories, and further wherein each of said pair of opposing longitudinal edges comprise a hanger attachment having a plurality of arcuate protrusions extending therefrom.

2. The hanging accessory organizer of claim 1, wherein said telescoping mounting hook comprises a plurality of telescoping holes disposed in a horizontal arm.

3. The hanging accessory organizer of claim 2, wherein said hanger attachment is comprised of a metal or a plastic.

4. The hanging accessory organizer of claim 3 further comprising a plurality of pockets positioned on a rear surface of said planar wall.

5. The hanging accessory organizer of claim 4, wherein said plurality of pockets on each of the front and rear surfaces of the planar wall comprise at least one divider slot for receiving a divider therebetween.

6. The hanging accessory organizer of claim 5, wherein said planar wall is comprised of a single contiguous piece of fabric material.

7. The hanging accessory organizer of claim 6, wherein said planar wall comprises a stiffener panel connected to a seam around said pair of opposing longitudinal edges and said pair of opposing lateral edges.

8. The hanging accessory organizer of claim 7, wherein said stiffener panel is sewn to said seam.

9. The hanging accessory organizer of claim 8, wherein said stiffener panel is surrounded by said single contiguous piece of fabric material of said planar wall.

10. The hanging accessory organizer of claim 9, wherein said stiffener panel is comprised of a plastic or a fiberboard.

11. The hanging accessory organizer of claim 10, wherein said plurality of pockets on each of the front and rear surfaces of the planar wall are comprised of a material selected from a group consisting of a transparent material, a translucent material and an opaque material.

12. The hanging accessory organizer of claim 1, wherein said rotating lever is fastened to a top lateral edge of said planar wall.

* * * * *